US008888344B2

(12) United States Patent
Tatsukawa

(10) Patent No.: US 8,888,344 B2
(45) Date of Patent: Nov. 18, 2014

(54) VEHICLE LAMP UNIT

(75) Inventor: Masashi Tatsukawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/040,322

(22) Filed: Mar. 4, 2011

(65) Prior Publication Data

US 2011/0222304 A1 Sep. 15, 2011

(30) Foreign Application Priority Data

Mar. 15, 2010 (JP) ..... 2010-057207

(51) Int. Cl.
*F21S 8/10* (2006.01)

(52) U.S. Cl.
CPC ..... *F21S 48/1159* (2013.01)
USPC ..... 362/518; 362/475; 362/507; 362/514; 362/516; 362/517

(58) Field of Classification Search
USPC ..... 362/518, 475, 507, 514, 516, 517
See application file for complete search history.

(56) References Cited

U.S. PATENT DOCUMENTS

| | | | | |
|---|---|---|---|---|
| 6,994,460 | B2 * | 2/2006 | Yamamura | 362/539 |
| 7,234,852 | B2 * | 6/2007 | Nishizawa et al. | 362/517 |
| 7,281,830 | B2 * | 10/2007 | Ishida | 362/538 |
| 7,416,323 | B2 * | 8/2008 | Okada et al. | 362/538 |
| 2005/0225995 | A1 * | 10/2005 | Komatsu et al. | 362/512 |

FOREIGN PATENT DOCUMENTS

| | | | |
|---|---|---|---|
| JP | 5-75904 | U | 10/1993 |
| JP | 2004-95480 | A | 3/2004 |
| JP | 2005-141917 | A | 6/2005 |
| JP | 2005-294176 | A | 10/2005 |

OTHER PUBLICATIONS

Notification of the First Office Action dated Nov. 1, 2012 issued by the State Intellectual Property Office of P.R. China in counterpart Chinese Patent Application No. 201110063480.2.
Office Action dated Dec. 10, 2013, issued by the Japanese Patent Office in counterpart Japanese Application No. 2010-057207.

* cited by examiner

*Primary Examiner* — Alan Cariaso
*Assistant Examiner* — Mark Tsidulko
(74) *Attorney, Agent, or Firm* — Sughrue Mion, PLLC

(57) ABSTRACT

A vehicle lamp unit comprising a cylindrical lens arranged on an optical axis extending in a front-back direction of the vehicle lamp unit, a semiconductor light-emitting element arranged on the optical axis behind a rear focal line of the cylindrical lens, and a reflector, which comprises a right concave curved surface located in a right side region of the reflector, and a left concave curved surface is located in a left side region of the reflector, wherein each of the right and left concave curved surfaces comprises an inner reflecting surface near the optical axis, wherein the light reflected by the inner reflecting surface of the right concave curved surface is directed to the left side region across the optical axis, and the light reflected by the inner reflecting surface of the left concave curved surface is directed to the right side region across the optical axis.

5 Claims, 5 Drawing Sheets

VEHICLE LAMP UNIT

CROSS-REFERENCE TO RELATED APPLICATION

This application claims priority from Japanese Patent Application No. 2010-057207, filed on Mar. 15, 2010, the entire contents of which are hereby incorporated by reference.

BACKGROUND

1. Technical Field

The present disclosure relates to a vehicle lamp unit which uses a semiconductor light-emitting element as a light source.

2. Related Art

In recent years, a vehicle lamp unit which uses a semiconductor light-emitting element, such as a light-emitting diode, as a light source, has frequently been adopted. Meanwhile, since the light flux of the semiconductor light-emitting element as a light source is small compared to a discharge bulb, a halogen bulb, or the like, for example, it is necessary to secure a sufficient amount of irradiation light through a configuration including a plurality of vehicle lamp units as in a vehicle illumination lamp described in JP-A-2005-294176.

The vehicle illumination lamp described in JP-A-2005-294176 includes a cylindrical lens which extends in the right-and-left directions, a plurality of light emitting elements (semiconductor light emitting elements) which are arranged at predetermined intervals in the right-and-left directions, and a plurality of reflectors which reflect light toward the front from the light emitting elements, and enhances the utilization rate of light flux to secure the amount of irradiation light.

A vehicle headlight described in JP-A-2004-95480 includes a plurality of lamp units which uses semiconductor light-emitting elements as light sources, and is adapted to be able to form a light distribution pattern with a desired pattern shape and light intensity (illuminance) distribution, using at least two types of lamp units among a projector type lamp unit, a direct-radiation-type lamp unit, and a reflective lamp unit.

Generally, in the light emitted from semiconductor light-emitting elements, an illuminance distribution exists such that the illuminance in the vicinity of the center of the light is large, and the illuminance is abruptly reduced as it moves away from the center. Thus, the light projected by a lamp unit including one semiconductor light-emitting element illuminates only a relatively narrow region in the vicinity of the center. Therefore, even in the vehicle lamp units described in JP-A-2005-294176 and JP-A-2004-95480, a region with weak illuminance exists between a plurality of semiconductor light-emitting elements or between respective optical axes of the lamp units, and it is difficult to obtain an irradiation pattern with uniform illuminance. Then, if a plurality of light emitting elements or lamp units is not used, it is difficult to obtain a wide irradiation pattern.

SUMMARY OF THE INVENTION

Exemplary embodiments of the present invention may address the above disadvantages and other disadvantages not described above. However, the present invention is not required to overcome the disadvantages described above, and thus, an exemplary embodiment of the present invention may not overcome any disadvantages.

It is an illustrative aspect of the present invention to provide a vehicle lamp unit which can obtain a wide irradiation pattern with uniform illuminance, while a semiconductor light-emitting element is used as a light source.

According to one or more illustrative aspects of the present invention, there is provided a vehicle lamp unit comprising a cylindrical lens arranged on an optical axis extending in a front-back direction of the vehicle lamp unit; a semiconductor light-emitting element arranged on the optical axis behind a rear focal line of the cylindrical lens; and a reflector which reflects, toward the front direction, light emitted from the semiconductor light-emitting element, wherein the reflector comprises a pair of right and left concave curved surfaces with the optical axis as the center, the right concave curved surface is located in a right side region of the reflector, and the left concave curved surface is located in a left side region of the reflector, wherein each of the right and left concave curved surfaces comprises an inner reflecting surface near the optical axis, wherein the light reflected by the inner reflecting surface of the right concave curved surface is directed to the left side region across the optical axis, and the light reflected by the inner reflecting surface of the left concave curved surface is directed to the right side region across the optical axis.

Other aspects and advantages of the present invention will be apparent from the following description, the drawings and the claims.

DETAILED DESCRIPTION OF EXEMPLARY EMBODIMENTS

According to the vehicle lamp unit of the invention, each of the concave curved surfaces of the reflector has a reflecting surface with a shape in which the light incident on an inner region near the optical axis is reflected across the optical axis to right and left opposite sides. Since the semiconductor light-emitting element has a large light flux in the vicinity of the center thereof, the light in the vicinity of the center is reflected across the optical axis to the right and left opposite sides by the inner region of the concave curved surface, so that sufficient reflected light can be irradiated toward a lateral side were light was originally insufficient.

Since the pair of right and left concave curved surfaces reflects light with a large illuminance to the opposite sides, respectively, in the overall lamp unit, the light with a large illuminance is reflected to the right and left. As a result, a wide irradiation pattern with uniform illuminance can be obtained by the resulting synthetic light.

Exemplary embodiments of the present invention will now be described below in detail with reference to the accompanying drawings.

<Overall Structure of Vehicle Headlight>

Figure 1:
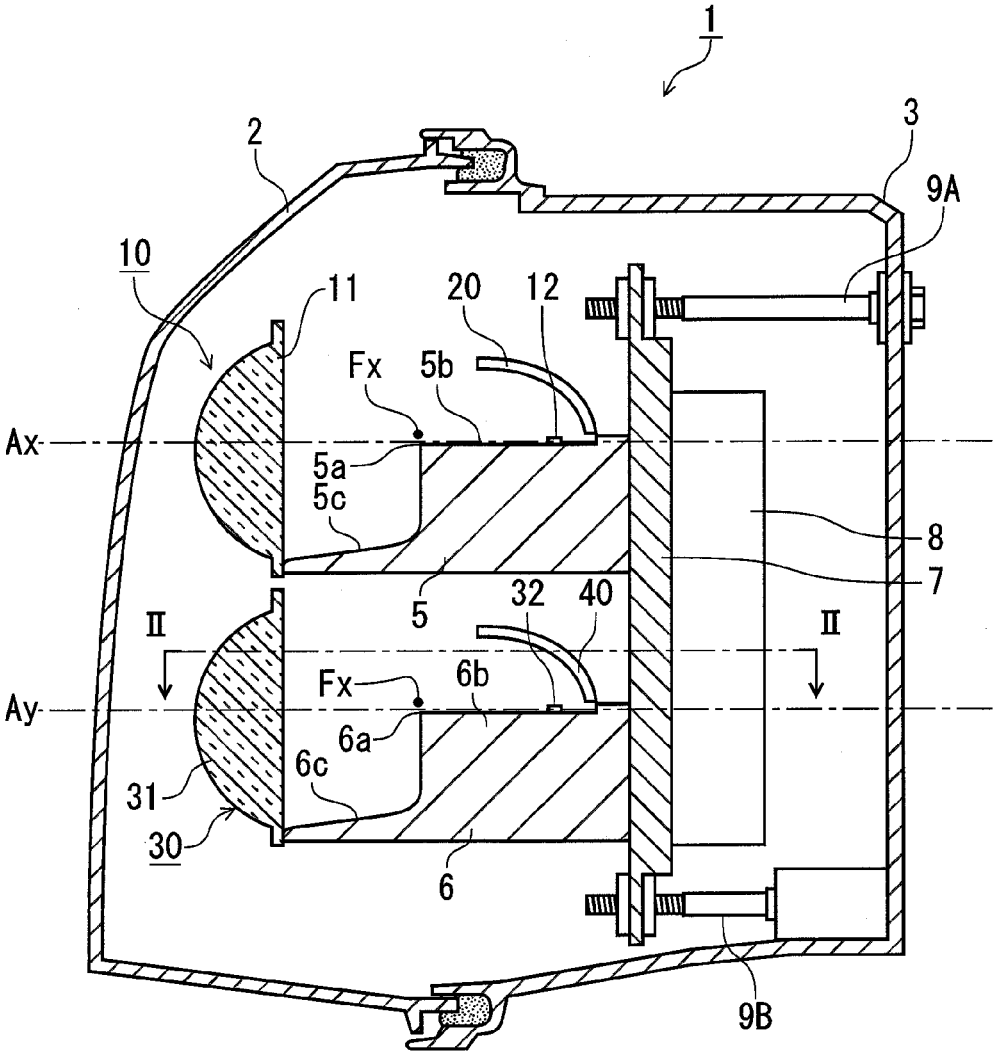
FIG. 1 is sectional view of a vehicle headlight including a vehicle lamp unit according to an embodiment of the invention.

A vehicle headlight 1 according to the present embodiment, as shown in FIG. 1, includes a plain-type translucent cover 2, a lamp body 3, and a condensing lamp unit 10 and a diffusing lamp unit (vehicle lamp unit of the invention) 30 which are housed within a lamp chamber formed by the translucent cover 2 and the lamp body 3.

The condensing lamp unit 10 is a well-known PES type lamp unit which emits a low beam having a cut-off line. As shown in FIG. 1, the condensing lamp unit 10 includes a convex lens 11 arranged on an optical axis Ax thereof, a first LED 12 which is a semiconductor light-emitting element arranged on the optical axis Ax behind a rear focal point Fx of the convex lens 11, a condensing reflector 20 with a substantially elliptical cross-section which condenses and reflects the light from the first LED 12 toward the front near the optical axis Ax, and a first shade 5 which shields a portion of the reflected light to form a cut-off line of a predetermined light distribution pattern. In addition, both of the horizontal cross-section and vertical cross-section of the condensing reflector 20 are elliptical.

The first LED 12 is a white light-emitting diode in which a light-emitting chip has, for example, a square light-emitting face with a size of about 1×4 $mm^2$. The first LED 12 is arranged behind the rear focal point Fx of the convex lens 11, and is arranged so that the light-emitting face is turned to the vertical upper side on the optical axis Ax.

In the first shade 5, a shading edge 5*a* (ridgeline between an upper surface 5*b* and a front end face 5*c*) is located near the rear focal point Fx of the convex lens 11 to shield a portion of the reflected light from the condensing reflector 20, thereby forming a cut-off line of a predetermined light distribution pattern.

Additionally, an additional reflecting surface which reflects a portion of the reflected light from the condensing reflector 20 upward is formed on the upper surface 5*b* of the first shade 5 which extends rearward in the direction of the optical axis Ax from the shading edge 5*a*. This causes the light shielded by the first shade 5 to be reflected, thereby enhancing the utilization rate of light flux of the light from the first LED 12.

In the condensing lamp unit 10, the light emitted from the first LED is condensed near the rear focal point Fx of the convex lens 11 by a substantially elliptical condensing reflector 20, and a portion of reflected light is shielded by the first shading edge 5*a* of the first shade 5 to form a predetermined light distribution pattern having a cut-off line with a relatively large illuminance.

The diffusing lamp unit 30 is the vehicle lamp unit according to the invention, and is constituted by a projector type lamp unit including a toroidal lens 31, which is a kind of cylindrical lens arranged on an optical axis Ay, a second LED (semiconductor light-emitting element) 32, which is arranged on the optical axis Ay behind a rear focal line Fy of the toroidal lens 31, a diffusing reflector 40 with a substantially elliptical vertical cross-section, which diffuses and reflects the light from the second LED 32 toward the front near the optical axis Ay, and a second shade 6, which shields a portion of reflected light, thereby forming a cut-off line of a predetermined light distribution pattern.

The second LED 32 is a white light-emitting diode in which a light-emitting chip has, for example, a square light-emitting face with a size of about 1×4 $mm^2$. The second LED 32 is arranged behind the rear focal line Fy of the toroidal lens 31, and is arranged so that a light-emitting face is turned to the vertical upper side on the optical axis Ay.

In the second shade 6, a shading edge 6*a* (ridgeline between an upper surface 6*b* and a front end face 6*c*) is located near the rear focal line Fy of the toroidal lens 31 to shield a portion of the reflected light from the diffusing reflector 40, thereby forming a cut-off line of a predetermined light distribution pattern. The shading edge 6*a* of the second shade 6 is formed in the shape of a circular arc so as to pass through the rear focal line Fy of the toroidal lens 31 (see FIG. 2).

Additionally, an additional reflecting surface which reflects a portion of the reflected light from the diffusing reflector 40 upward is formed on the upper surface 6*b* of the second shade 6, which extends rearward in the direction of the optical axis Ay from the shading edge 6*a*. This causes the light shielded by the shade 6 to be reflected, thereby enhancing the utilization rate of light flux of the light from the second LED 32.

The first shade 5 and the second shade 6 are block-shaped members, and both are coupled together by a frame 7. Additionally, radiating fins 8, which radiate the heat from the first LED 12 and the second LED 32 are attached to the frame 7.

The condensing lamp unit 10 and diffusing lamp unit 30 which are configured in this way are supported on the lamp body 3 via the frame 7, an aiming mechanism 9A, and a leveling mechanism 9B.

Additionally, the condensing lamp unit 10 and the diffusing lamp unit 30 are arranged such that the optical axes Ax and Ay thereof extend in the longitudinal direction of the vehicle. The optical axes Ax and Ay are accurately adjusted by the aiming mechanism 9A so as to extend downward at about 0.5 to 0.6° with respect to the horizontal direction. Additionally, the optical axes can be adjusted in the vertical direction by the leveling mechanism 9B.

<Reflector Shape of Diffusing Lamp Unit>

Next, the shape of the diffusing reflector 40 of the diffusing lamp unit 30 according to the invention will be described in detail with reference to FIG. 2.

Figure 2:
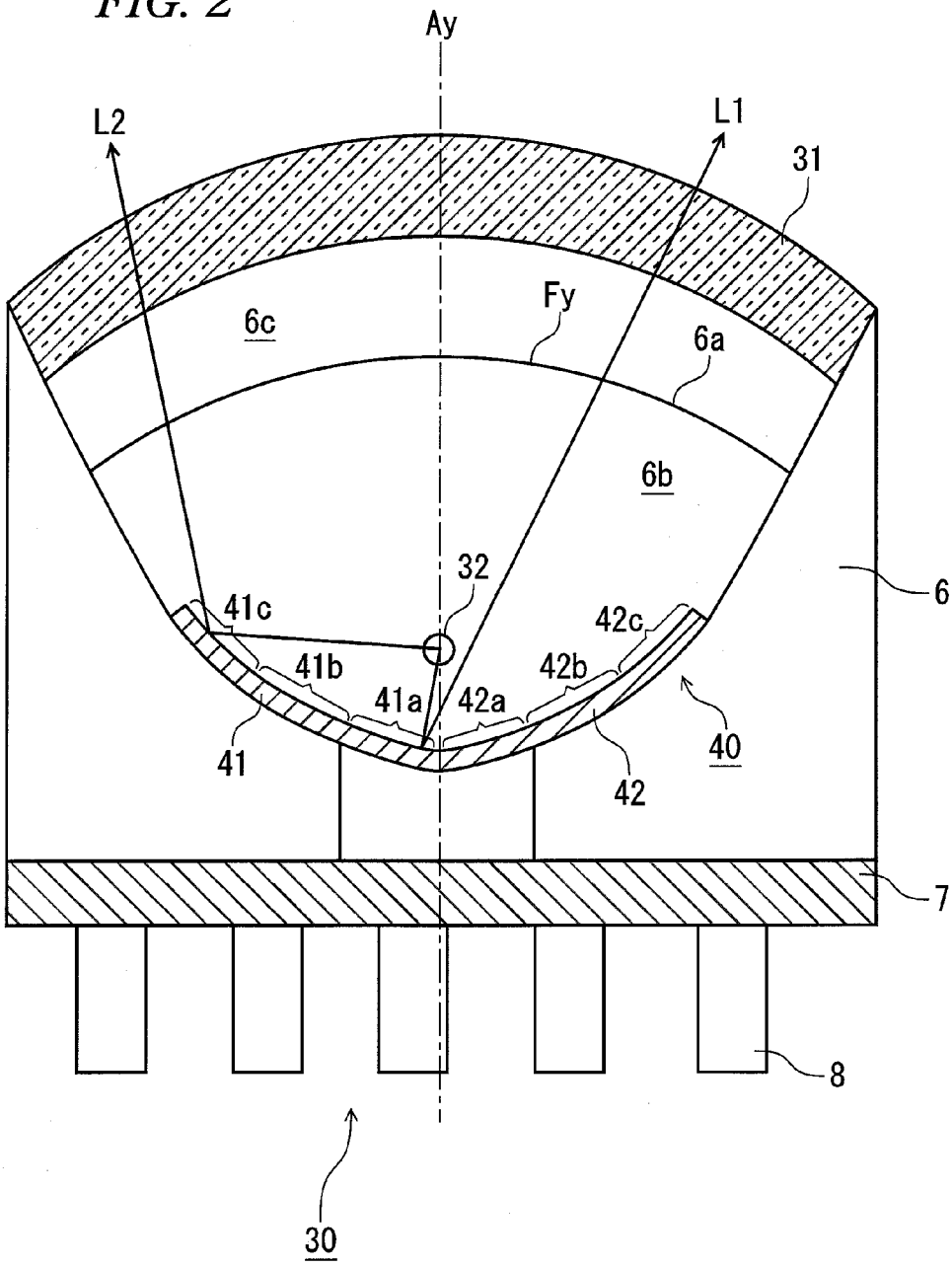
FIG. 2 is a view as seen from the direction of an arrow II-II of FIG. 1.

FIG. 2 is a view as seen from the direction of an arrow II-II of FIG. 1. The diffusing reflector 40 is placed on the upper surface 6*b* of the second shade 6, and one pair of right and left concave curved surfaces 41 and 42 with the optical axis Ay as a center. In addition, in the present embodiment, the left concave curved surface 41 and the right concave curved surface 42 form portions of hyperbolas in a horizontal cross-section, and are bilaterally symmetrical about the optical axis Ay.

The reflecting surface of the left concave curved surface 41 has an inner region 41*a* near the optical axis Ay side, an outer region 41*c* located outside the inner region 41*a*, and an intermediate region 41*b* which is located between the inner region 41*a* and the outer region 41*c* to connect both smoothly. The reflecting surface of the right concave curved surface 42 is also constituted by an inner region 42*a*, an intermediate region 42*b*, and an outer region 42*c* which are bilaterally symmetrical with respect to the left concave curved surface 41. In addition, since the right concave curved surface 42 is bilaterally symmetrical with respect to the left concave curved surface 41, detailed description thereof is omitted herein.

The inner region 41*a* in the reflecting surface of the left concave curved surface 41 is tilted with respect to the optical axis Ay so as to reflect the incident light L1 from the second LED 32 to the right opposite to the left concave curved surface across the optical axis Ay. At this time, the inner region

41*a* of the left concave curved surface 41 has a shape, which reflects the incident light with a large light flux in the vicinity of the optical axis Ay to the right at 20 degrees or more with respect to the optical axis Ay, and extends the irradiation range of the diffusing lamp unit 30.

On the other hand, the outer region 41*c* in the reflecting surface of the left concave curved surface 41 is provided so as to reflect the incident light L2 from the second LED 32 to the left. That is, the inner region 41*a* of the reflecting surface reflects incident light to the opposite side (L1) across the optical axis Ay, and the outer region 41*c* of the reflecting surface reflects incident light to the same side (L2) with respect to the optical axis Ay. By irradiating light to different sides in the inner region 41*a* and the outer region 41*c* of the reflecting surface in this way, the irradiation range of the diffusing lamp unit 30 is extended.

Additionally, the intermediate region 41*b* of the reflecting surface has a shape, which extends from the inside to the outside, and reflects the incident light from the second LED 32 to the left from the right. The regions 41*a* to 41*c* of the reflecting surface are connected by smooth hyperbolic curves in the horizontal cross-section so as to reflect incident light uniformly to the right and left.

Moreover, in the reflecting surface of the concave curved surface 41, the outer region 41*c* is provided at a position more distant from the second LED 32 than the inner region 41*a*. Since the light flux of the light from the second LED 32, which spreads in a radial fashion becomes smaller in a region more distant from the second LED 32, if the outer region 41*c* of the left concave curved surface 41 is more distant from the second LED 32 than the inner region 41*a*, the inner region 41*a* reflects incident light with a larger light flux to the right, and the outer region 41*c* reflects incident light with a smaller light flux to the left.

At this time, even in the right concave curved surface 42, similar to the left concave curved surface 41, the inner region 42*a* reflects light with a larger light flux to the left of the optical axis Ay. Thus, the synthesized light formed by the light with a larger light flux, which is reflected by the inner region 42*a* of the reflecting surface of the right concave curved surface 42 and the light with a smaller light flux, which is reflected by the outer region 41*c* of the reflecting surface of the left concave curved surface 41 are irradiated to the front left region of the vehicle. Similarly, since the synthesized light of the reflected light with a larger light flux by the inner region 41*a* of the left concave curved surface 41 and the reflected light with a smaller light flux by the outer region 42*a* of the right concave curved surface 42 are also irradiated to the front right region of the vehicle, the overall diffusing reflector 40 can irradiate a wide range with uniform illuminance. As such, according to the diffusing lamp unit 30, it is possible to obtain a wide irradiation range with uniform illuminance on the right and left.

<Irradiation Range of Lamp Unit>

The irradiation range capable of being formed by the diffusing lamp unit 30 will be described in detail with a comparative example.

Figure 3B:
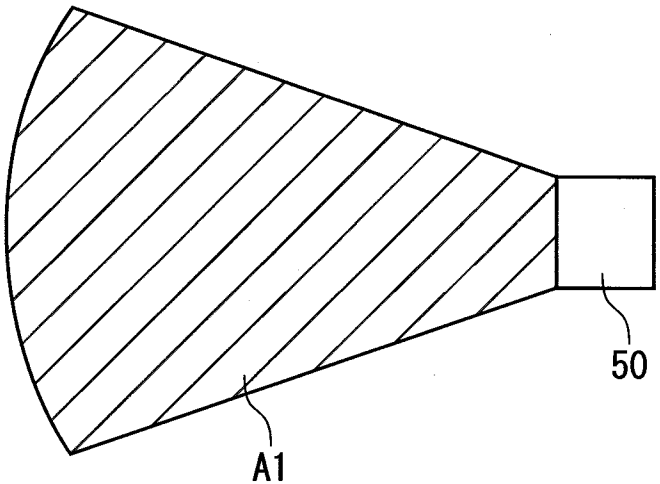
FIG. 3B is a schematic view of a light distribution pattern formed on a road surface by irradiation light of the diffusing lamp unit according to the comparative example.
Figure 3A:
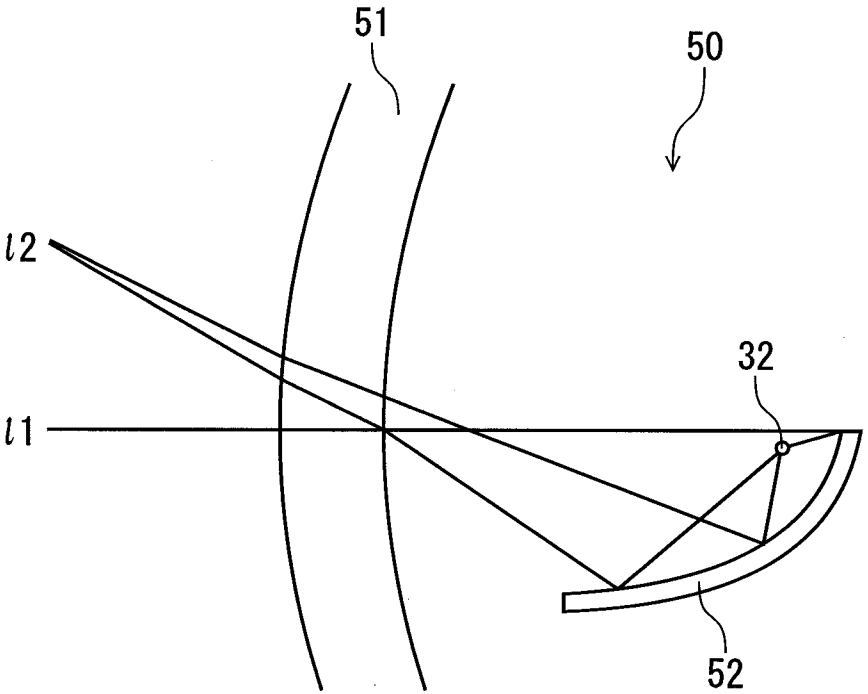
FIG. 3A is a schematic view showing reflected rays of a diffusing lamp unit according to a comparative example.
Figure 4B:
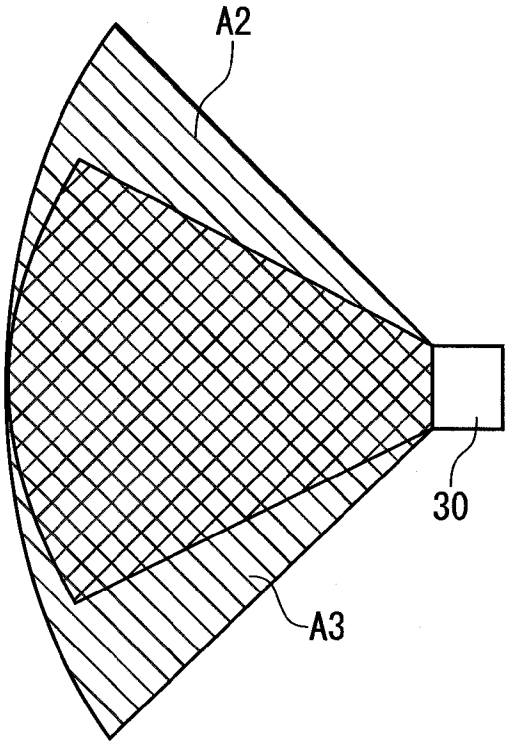
FIG. 4B is a schematic view of a light distribution pattern formed on a road surface by irradiation light of the diffusing lamp unit according to the embodiment of the invention.
Figure 4A:
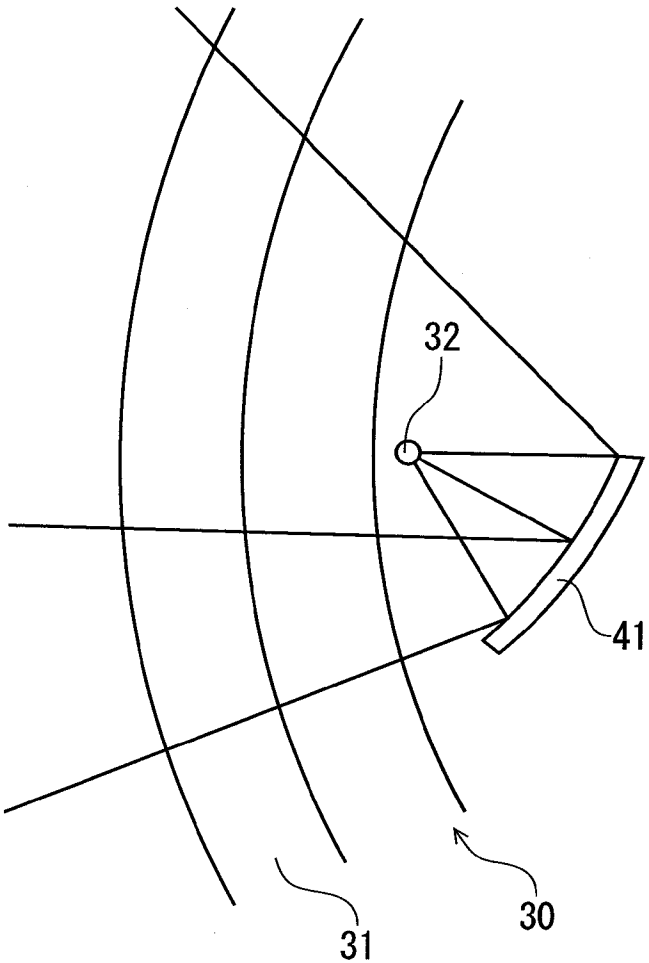
FIG. 4A is a schematic view showing reflected rays of a diffusing lamp unit according to an embodiment of the invention.

FIG. 3A is a schematic view showing reflected rays of a diffusing lamp unit 50 according to a comparative example, and FIG. 3B is a schematic view of a light distribution pattern A1 formed on a road surface by irradiation light of the diffusing lamp unit 50 according to the comparative example. FIG. 4A is a schematic view showing reflected rays of the diffusing lamp unit 30 according to the invention, and FIG. 4B is a schematic view of light distribution patterns A2 and A3 formed on a road surface by irradiation light of the diffusing lamp unit 30 according to the invention. In addition, FIGS. 3B and 4B show regions where the light of specific illuminance or more is to be irradiated, as the light distribution patterns A1 to A3.

The diffusing lamp unit 50 according to the conventional comparative example has a toroidal lens 51 and a reflector 52 with a substantially elliptical horizontal cross-section. In addition, only the left half of the reflector 52 is shown in FIG. 3A.

In the diffusing lamp unit 50 of the comparative example, a light ray 11 with high illuminance at the center of the optical axis is reflected in the inner region located at the bottom of the reflecting surface with a substantially elliptical horizontal cross-section in the reflector 52, and passes through the toroidal lens 51, and the reflected light goes straight and is projected onto the front of the vehicle. On the other hand, a light ray 12 with a low illuminance out of the center of the optical axis is reflected to the lateral side on the opposite side across the optical axis outside the reflecting surface, and is further projected to the lateral side by the toroidal lens 51. As a result, the light with high illuminance at the center of the optical axis is concentrated on and projected to the front of the vehicle as shown in FIG. 3B, and only the light with low illuminance is projected to the lateral side. As a result, an elongated light distribution pattern A1 is formed on a road surface ahead of a vehicle.

On the other hand, according to the diffusing lamp unit 30 of the invention, in the above-described diffusing reflector 40, the light which has been incident on the reflecting surface of the concave curved surface 41 or 42 of the inner region 41*a* or 42*a* near the optical axis Ay can be reflected to the opposite side across the optical axis Ay. Accordingly, as shown in FIG. 4A, the light emitted from the second LED 32 can be reflected with uniform illuminance within a wide range in the concave curved surfaces 41 and 42.

As a result, as shown in FIG. 4B, in the diffusing lamp unit 30 of the invention, the right and left concave curved surfaces 41 and 42 can form the light distribution patterns A2 and A3 with uniform illuminance within a wide range, respectively, on a road surface. Thus, the diffusing lamp unit 30 can obtain a wide irradiation region with uniform light intensity as a synthetic pattern of the light distribution patterns A2 and A3 as a whole. In addition, only the left half of the reflector 52, similarly to FIG. 3A, is also shown in FIG. 4A.

<Light Distribution Pattern of Vehicle Headlight>

Figure 5:
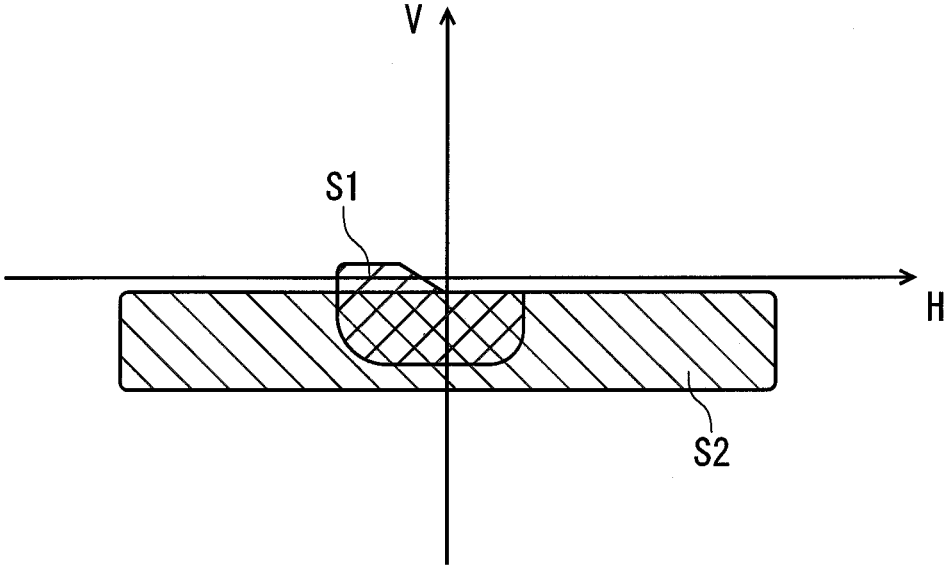
FIG. 5 is a schematic view perspectively showing light distribution patterns formed on a virtual vertical screen by the irradiation light of the vehicle headlight according to the embodiment of the invention.

Since the vehicle headlight 1 according to the invention includes the above-described condensing lamp unit 10 and diffusing lamp unit 30, light distribution patterns as shown in FIG. 5 can be irradiated. In addition, FIG. 5 is a view perspectively showing light distribution patterns formed on a virtual vertical screen located 25 m ahead of a vehicle by the irradiation light of the vehicle headlight 1 according to the embodiment of the invention. In addition, in the drawing, V means a vertical direction and H means a horizontal direction.

As shown in FIG. 5, a light distribution pattern S1 with high illuminance can be irradiated to, especially, a central region ahead of a vehicle which requires visibility by the condensing lamp unit 10, and can also irradiate a light distribution pattern S2 with uniform illuminance to a side region by the diffusing lamp unit 30. Accordingly, separately from especially the central region which requires visibility ahead of a vehicle, for example, surrounding roadsides, pedestrians, or the like can be clearly viewed by the light distribution pattern S2 by the diffusing lamp unit 30. Hence, it is possible to provide the vehicle headlight 1 which can allow safe driving of a vehicle.

Although the vehicle headlight 1 in which the diffusing lamp unit 30 is combined with the condensing lamp unit 10 has been described as an example in the above description, the present invention is not limited to this configuration. For example, it is possible to adopt a configuration which uses a fog lamp which can irradiate a wide range using the diffusing lamp unit 30 serving as a single body.

In addition, although the case where the right and left concave curved surfaces 41 and 42 of the diffusing reflector 40 are bilaterally symmetrical to each other about the optical axis Ay has been described in the above-described embodiment, the invention is not limited to this case. The right and left concave curved surfaces may be bilaterally asymmetrical to each other by changing the orientation of the concave curved surfaces of the reflector in accordance with a direction in which a desired light distribution pattern or light is irradiated.

While the present invention has been shown and described with reference to certain exemplary embodiments thereof, other implementations are within the scope of the claims. It will be understood by those skilled in the art that various changes in form and details may be made therein without departing from the spirit and scope of the invention as defined by the appended claims.

What is claimed is:

1. A vehicle lamp unit comprising:

a cylindrical lens arranged on an optical axis extending in a front-back direction of the vehicle lamp unit;

a semiconductor light-emitting element arranged on the optical axis behind a rear focal line of the cylindrical lens; and a reflector which reflects, toward the front direction, light emitted from the semiconductor light-emitting element, wherein the reflector comprises a pair of right and left concave curved surfaces with the optical axis as the center, the right concave curved surface is located in a right side region of the reflector, and the left concave curved surface is located in a left side region of the reflector, wherein each of the right and left concave curved surfaces comprises an inner reflecting surface near the optical axis, wherein the light reflected by the inner reflecting surface of the right concave curved surface is directed to the left side region across the optical axis, and the light reflected by the inner reflecting surface of the left concave curved surface is directed to the right side region across the optical axis wherein each of the right and left concave curved surfaces further comprises an outer reflecting surface located outside the inner reflecting surface, wherein the light reflected by the outer reflecting surface of the right concave curved surface is directed to the right side region, the light reflected by the outer reflecting surface of the left concave curved surface is directed to the left side region, wherein the light reflected by the inner reflecting surface of the right concave curved surface, the light reflected by the inner reflecting surface of the left concave curved surface, the light reflected by the outer reflecting surface of the right concave curved surface, and the light reflected by the outer reflecting surface of the left concave curved surface pass through the cylindrical lens, wherein the light reflected by the outer reflecting surface of the right concave curved surface is directed away from the optical axis, and the light reflected by the outer reflecting surface of the left concave curved surface is directed away from the optical axis, and wherein the inner and outer reflecting surfaces of the left concave curved surface are connected by hyperbolic curves and the inner and outer reflecting surfaces of the right concave curved surface are connected by hyperbolic curves.

2. The vehicle lamp unit according to claim 1, wherein the outer reflecting surface of each of the right and left concave curved surfaces is located farther away from the optical axis than the inner reflecting surface.

3. The vehicle lamp unit according to claim 1, wherein the light reflected by the inner reflecting surface of each of the right and left concave curved surfaces intersects the optical axis at an angle of 20 degrees or more.

4. The vehicle lamp unit according to claim 1, wherein the cylindrical lens is a toroidal lens.

5. The vehicle lamp unit according to claim 1, wherein the light reflected by the inner reflecting surface of the right concave curved surface crosses the optical axis between the semiconductor light-emitting element and the reflector, and the light reflected by the inner reflecting surface of the left concave curved surface crosses the optical axis between the semiconductor light-emitting element and the reflector.

* * * * *